United States Patent [19]

von Bernuth et al.

[11] Patent Number: 4,645,030

[45] Date of Patent: Feb. 24, 1987

[54] MULTI-FUNCTION DIRECTIONAL HANDLE

[75] Inventors: Hans-Dietrich von Bernuth; Franz Heine, both of Dortmund, Fed. Rep. of Germany

[73] Assignee: O&K Orenstein & Koppel Aktiengesellschaft, Berlin, Fed. Rep. of Germany

[21] Appl. No.: 593,728

[22] Filed: Mar. 26, 1984

[30] Foreign Application Priority Data

Mar. 24, 1983 [DE] Fed. Rep. of Germany ..... 3310626

[51] Int. Cl.[4] ..... B60K 26/00

[52] U.S. Cl. ..... 180/333; 180/315; 414/4; 74/523

[58] Field of Search ..... 74/523; 180/315, 333, 180/326, 324; 244/234, 76 R; 173/18; 414/2, 4, 5, 6

[56] References Cited

U.S. PATENT DOCUMENTS

| | | | |
|---|---|---|---|
| 2,566,526 | 9/1951 | Lecarme | 244/234 |
| 3,800,969 | 4/1974 | Steiger | 180/333 |
| 3,821,498 | 6/1974 | Schaefer, Jr. et al. | 414/4 |
| 3,880,304 | 4/1975 | Strickland, Jr. | 414/2 |
| 3,937,294 | 2/1976 | Haddock | 74/523 |
| 4,059,196 | 11/1977 | Uchino et al. | 414/699 |
| 4,352,401 | 10/1982 | Vitaloni | 180/90 |
| 4,399,888 | 8/1983 | Contato | 180/315 |
| 4,478,308 | 10/1984 | Klaassen | 180/326 |

*Primary Examiner*—Donald R. Schran
*Assistant Examiner*—James L. Wolfe
*Attorney, Agent, or Firm*—Martin A. Farber

[57] ABSTRACT

A multi-function directional handle with control elements mounted for turning in both directions is arranged as a single structural unit, in which unit an axially supported control spoke with hand-grippable, individually movable control levers at its ends is provided adjustably fixed in a position within the region of grip in front of the driver's seat of a construction machine. The control levers each define an opening, wherein finger-displaceable dump lever is mounted in each such opening, the axes of swing of the control and dump levers extending, approximately parallel, to the pivot axes of the controlled tool parts, and the direction of turn of the human control movements agreeing with that of the movements controlled.

10 Claims, 1 Drawing Figure

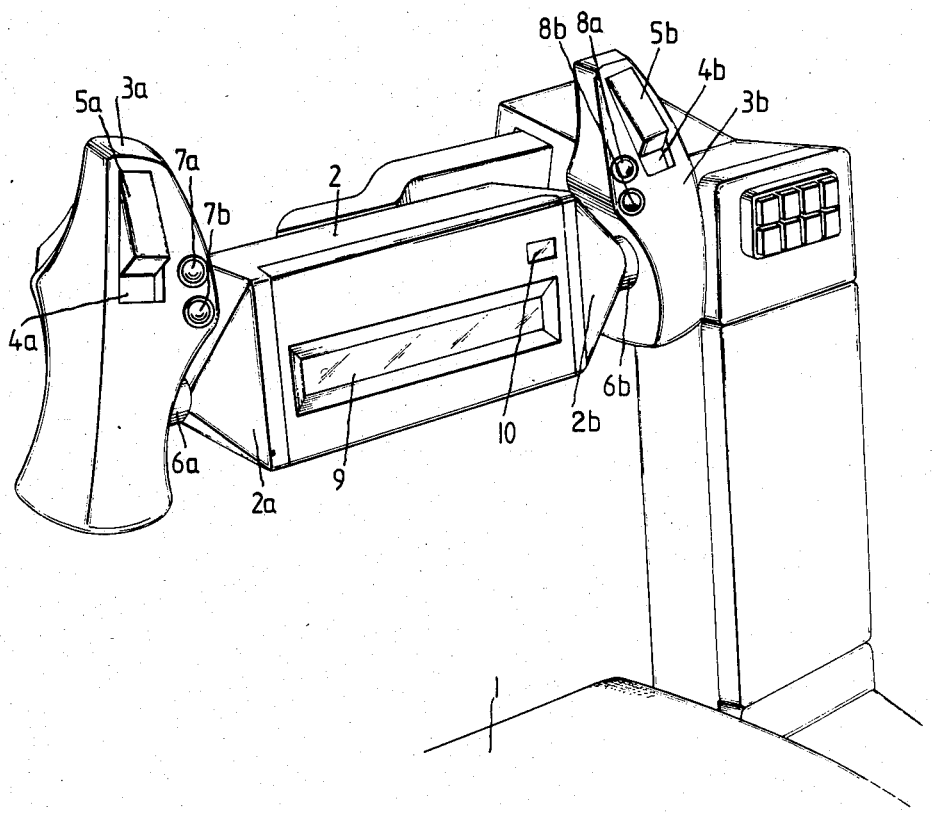
8b
8a
5b
4b
3b
5a
3a
7a
7b
2
4a
6b
10
2b
6a
9
2a
1

MULTI-FUNCTION DIRECTIONAL HANDLE

The invention relates to a multi-function directional handle having control elements mounted for turning in both directions arranged as a single structural unit.

The operating cylinders and engines of construction machines, for instance hydraulic excavators, are actuated by the human operator via hydraulic control valves. An excavator is typically configured having four to six operation control valve pistons, which pistons are actuated in the course of an operational cycle, in part one after the other and in part simultaneously. The force of the human control movements of the operator is typically transmitted directly, or via force-assisting pre-control systems, to the above said control valve pistons. The control valve pistons, in turn, control actuation of various displacement members of the excavator, such as control of the boom, jib, dipper stick, shovel or superstructure of the excavator. Furthermore, a system having two control sticks is generally provided for control of the said displacement members. The control sticks can be actuated in such a manner that eight control functions result. These functions can be represented as follows:

raise boom
lower boom
extend dipper stick
retract dipper stick
tip shovel out
tip shovel in
swing superstructure to right
swing superstructure to left.

If further functions are necessary, pedal controls can also be used.

Also as part of the humanizing of work stations, one fundamental requirement of ergonomy is that work movements carried out by tool parts follow in the same direction as the control movement effected. This requirement is only partially satisfied in the known systems. Thus in the case of excavator controls, the customary transverse actuation for the shovel moving in longitudinal direction and diagonal actuation of the control sticks upon two simultaneous movements is contrary to the natural expectations of the operator and requires unreasonable concentration, thus resulting in mental stress. Additional simultaneous or successive pedal actuations then lead to the very limits of human capabilities.

The object of the invention is to provide a control device for construction machines, particularly excavators, which has an ergonomically more optimum movement of the control levers.

A directional handle is already known for use as a control device for the setting, in particular, of three and more values (Anzeiger und Bedienteile, Alfred Neudorfer, published by VDI Verlag, Düsseldorf 1981, pages 100 and 101).

The present invention comprises a multi-function directional handle for solution of the problem described above. More particularly, the invention comprises an axially mounted control spoke with hand-grippable, individually movable control levers on its ends, which spoke is adjustably fixed in position within the human operator's range of grip in front of the operator's seat in a construction machine. The control levers define openings such as two openings on each said control lever, for housing settable dump levers. The axes of swing of the control and dump levers extend approximately parallel to the respective pivot axes of the tool parts controlled, where the direction of the resulting control movements corresponds with that of the movements controlled.

In this connection, the control levers have additional operating buttons. A display panel is provided on the control spoke in the direction of its longitudinal axis, and signal lamps can furthermore be arranged on said spoke.

The advantage of the invention is that all work movements of the parts controlled correspond in direction to the control movements effected. A separate control element is associated with each work movement. This affords the possibility of being able to automate recurrent courses of movement. The control device, arranged fixed in space within the region of grip in front of the driver's seat, serves additionally as a point of support for the operator.

One diagrammatic embodiment of the invention will be explained below with reference to the drawing.

The FIGURE of the drawing shows a multi-function handle with control elements mounted for turning in both directions, arranged as a single structural unit. An axially supported control spoke 2, having hand-grippable, individually movable control levers 3*a* and 3*b* at its ends, is provided adjustably fixed in position within the region of grip in front of the driver's seat 1 of a construction machine. The control levers 3*a*, 3*b* respectively define openings 4*a*, 4*b*, each of which openings cooperate with a respective finger-displaceable dump lever 5*a*, 5*b*. The axes of rotation of coupling elements 6*a* and 6*b* of the control levers 3*a* and 3*b* (as well as of the dump levers 5*a* and 5*b* housed in control levers 3*a*, 3*b*) are designed to be approximately parallel to the pivot axes of the controlled parts of the tools. The raising and lowering movements of the jib or of the dipper stick or the like may be thus controlled.

From the drawing it can be noted that the control spoke 2, which is mounted approximately horizontally, is fastened to a stand which is connected to the bottom of the driver's cab.

The control levers 3*a* and 3*b* have additional operating buttons 7*a* and 7*b* and 8*a* and 8*b* respectively.

On the side of the control spoke 2 towards the driver a display panel 9 is provided in the direction of the longitudinal axis of the spoke. This may be a display of an onboard computer which displays available operating data of the construction machine. A signal lamp 10 is also provided in the control spoke 2.

In practice of the invention, an ergonomically optimal movement of the equipment control elements, as such movement is related to the tool parts controlled, can now be obtained. Thus, by turning the control spoke 2, a turning of the revolving superstructure of the excavator in the same direction of rotation of the spoke is obtained. Also, the two control levers 3*a* and 3*b* produce a corresponding swinging of the excavator boom and of the dipper stick. Furthermore, working movements of the excavator shovel or of a shovel flap are in the same direction as the control movements of the dump levers 5*a* and 5*b*.

In a preferred embodiment, the multi-function directional handle is used in combination with an electrohydraulic pre-control. In that case, the control element movements are transmitted via potentiometers to solenoid valves by means of which the control pressure for the actuating of the control valves is set.

What is claimed is:

1. A control device for controlling of a course of movement of a working device and of pivotal movement of superstructure of a construction machine, particularly a hydraulic excavator, with control elements mounted for turning in both directions, said control elements comprising:

an axially mounted turnable control spoke for said pivotal movement of the superstructure;

said spoke provided turnably adjustably fixed in position in front of an operator's seat of the construction machine and having left and right ends positioned corresponding to left and right hands of the operator;

a pair of hand-grippable individually movable directional control handles corresponding to left and right hands of the operator, one each of the control handles being pivotally mounted on respective ends of said spoke;

said control handles at least at top portions thereof facing the seat defining with respect thereto relatively small openings;

finger-displaceable directional dump levers pivotally mounted within said openings;

the size and position of said control handles and said dump levers being such that, said control handles being turnable by the operator's hands while said hands grip thereon while said dump levers being movable by respective fingers of the operator's hands while the operator's hands grip said control handles; and the pivot axes of the control handles and dump levers extending, approximately parallel, to the pivot axes of controlled pivotal parts of the excavator and of the operator's hands and said fingers of the operator's hands and the directions of pivoting of the movements of the control elements agreeing with that of the movements controlled of the working device, and of the operator's hands and said fingers of the operator's hands.

2. The device according to claim 1, wherein said control handles further comprise a plurality of additional operating buttons.

3. The device according to claim 1, wherein said control spoke includes a display panel in the direction of its longitudinal axis.

4. The device according to claim 1, wherein said control spoke further comprises signal lamps.

5. The device according to claim 1, further comprising coupling elements, each of such elements coupling a respective one of said pair of control levers to said spoke.

6. The device according to claim 1, further comprising an inverted L-shaped stand extending from the operator's seat to the front thereof and including a horizontal portion, said control spoke being turnably mounted to said horizontal portion.

7. The device according to claim 1, wherein one of said control handles is for pivoting a boom of said excavator, the other of said control handles is for pivoting a dipper of said excavator, and said dump levers are for pivoting a tool of said excavator.

8. The control device as set forth in claim 1, wherein said openings are also located on said top portions of said control handles facing away from said seat for movement of a dump lever disposed therein by forefingers of the operator's hand, said first-mentioned fingers being thumbs.

9. A control device for controlling of a course of movement of a working device and of pivotal movement of superstructure of a construction machine, particularly a hydraulic excavator, with control elements mounted for turning in both directions, said control elements comprising:

an axially mounted turnable control spoke for said pivotal movement of the superstructure;

said spoke provided turnably adjustably fixed in position in front of an operator's seat of the construction machine;

a pair of hand-grippable individually movable directional control handles, one each of the latter being pivotally mounted on a respective end of said spoke;

said control handles defining openings;

finger-displaceable directional dump levers are pivotally mounted within said openings;

the pivot axes of the control handles and dump levers extending, approximately parallel, to the pivot axes of controlled pivotal parts of the excavator and the directions of pivoting of the movements of the control elements agreeing with that of the movements controlled of the working device, said control handles are shaped mirror-symmetric with respect to each other having outermost surfaces with a first radius of curvature and lower inner surfaces, respectively facing said ends of said control spoke, having a second radius of curvature smaller than said first radius of curvature, said control handles are pivotally mounted on said ends of said control spoke centrally at said second radius of curvature and have upper portions extending upwardly projecting a substantial distance above an uppermost surface of said control spoke, and said openings in said control handles are formed in said upper portions of said control handles facing the operator's seat above said uppermost surface of said control spoke.

10. A control device for controlling of a course of movement of a working device and of pivotal movement of superstructure of a construction machine, particularly a hydraulic excavator, with control elements mounted for turning in both directions, said control elements comprising:

an axially mounted turnable control spoke for said pivotal movement of the superstructure;

said spoke provided turnably adjustably fixed in position in front of an operator's seat of the construction machine;

a pair of hand-grippable individually movable directional control handles, one each of the latter being pivotally mounted on a respective end of said spoke;

said control handles defining openings;

finger-displaceable directional dump levers are pivotally mounted within said openings;

the pivot axes of the control handles and dump levers extending, approximately parallel, to the pivot axes of controlled pivotal parts of the excavator and the directions of pivoting of the movements of the control elements agreeing with that of the movements controlled of the working device, an inverted L-shaped stand extending from the operator's seat to the front thereof and including a horizontal portion, said control spoke being turnably mounted to said horizontal portion, said control handles are shaped mirror-symmetric with respect to each other having outermost surfaces with a first radius of curvature and lower inner surfaces, respectively facing said ends of said control spoke, having a second radius of curvature smaller than said first radius of curvature, said control handles are pivotally mounted on said ends of said control spoke centrally at said second radius of curvature and have upper portions extending upwardly projecting a substantial distance above an uppermost surface of said control spoke, and said openings in said control handles are formed in said upper portions of said control handles facing the operator's seat above said uppermost surface of said control spoke.

* * * * *